US008887637B2

(12) United States Patent
Huber et al.

(10) Patent No.: US 8,887,637 B2
(45) Date of Patent: Nov. 18, 2014

(54) METHOD FOR COLOR MEASUREMENT IN PRINTING PRESSES

(75) Inventors: Werner Huber, Wiesloch (DE); Manfred Schneider, Bad Rappenau (DE); Wolfgang Geissler, Bad Schönborn (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 991 days.

(21) Appl. No.: 11/731,472

(22) Filed: Mar. 30, 2007

(65) Prior Publication Data

US 2007/0227389 A1 Oct. 4, 2007

(30) Foreign Application Priority Data

Mar. 30, 2006 (DE) ..... 10 2006 014 749

(51) Int. Cl.
*B41F 33/00* (2006.01)

(52) U.S. Cl.
CPC ..... *B41F 33/0036* (2013.01)
USPC ..... 101/484; 101/485

(58) Field of Classification Search
USPC ..... 101/484, 485
See application file for complete search history.

(56) References Cited

U.S. PATENT DOCUMENTS

| | | | | |
|---|---|---|---|---|
| 5,182,721 | A * | 1/1993 | Kipphan et al. | 382/112 |
| 5,774,225 | A | 6/1998 | Goldstein et al. | |
| 5,835,626 | A | 11/1998 | Huber et al. | |
| 6,018,385 | A * | 1/2000 | Lampersberger et al. | 356/73 |
| 6,119,594 | A | 9/2000 | Kipphan et al. | |
| 6,454,474 | B1 * | 9/2002 | Lesniak et al. | 400/582 |
| 6,705,229 | B2 * | 3/2004 | Frankenberger | 101/484 |
| 6,836,625 | B2 * | 12/2004 | Shiratori | 399/49 |
| 2004/0042022 | A1 * | 3/2004 | Friedman et al. | 358/1.9 |
| 2005/0183595 | A1 * | 8/2005 | Kiyohara | 101/365 |
| 2005/0199151 | A1 * | 9/2005 | Holten et al. | 101/484 |
| 2006/0191436 | A1 * | 8/2006 | Kiyohara | 101/484 |
| 2007/0081204 | A1 | 4/2007 | Ehbets et al. | |
| 2007/0227389 | A1 | 10/2007 | Huber et al. | |
| 2007/0283830 | A1 * | 12/2007 | Pfeiffer | 101/484 |
| 2008/0236430 | A1 * | 10/2008 | Elter et al. | 101/484 |

FOREIGN PATENT DOCUMENTS

| | | | |
|---|---|---|---|
| DE | 4321179 | A1 | 1/1995 |
| DE | 10 2004 021 601 | A1 | 12/2005 |
| DE | 102004021599 | A1 | 12/2005 |
| DE | 102006014657 | A1 | 10/2007 |
| DE | 102007011344 | A1 | 10/2007 |
| EP | 0 741 029 | A2 | 11/1996 |

(Continued)

OTHER PUBLICATIONS

German Search Report dated Sep. 4, 2008.

*Primary Examiner* — David Banh
(74) *Attorney, Agent, or Firm* — Laurence A. Greenberg; Werner H. Stemer; Ralph E. Locher

(57) ABSTRACT

A color measurement on printed materials produced by a printing press is performed by at least a first color measuring device installed in the printing press and at least a second color measuring device. A signal is output by the first color measuring device in the printing press when the measured color values registered on the printing materials are located within a predefined tolerance limit for a predefined period and that, after the signal has been output, a color measurement on one of the printed materials thus produced is performed with the second color measuring device.

11 Claims, 1 Drawing Sheet

(56) References Cited

FOREIGN PATENT DOCUMENTS

| | | | | | |
|---|---|---|---|---|---|
| EP | 0 798 117 | A2 | | 10/1997 | |
| JP | 9094941 | A | | 4/1997 | |
| JP | 2004330563 | A | | 11/2004 | |
| WO | WO 2005108083 | A1 | * | 11/2005 | ..... B41F 33/00 |
| WO | 2007110317 | A1 | | 10/2007 | |

* cited by examiner

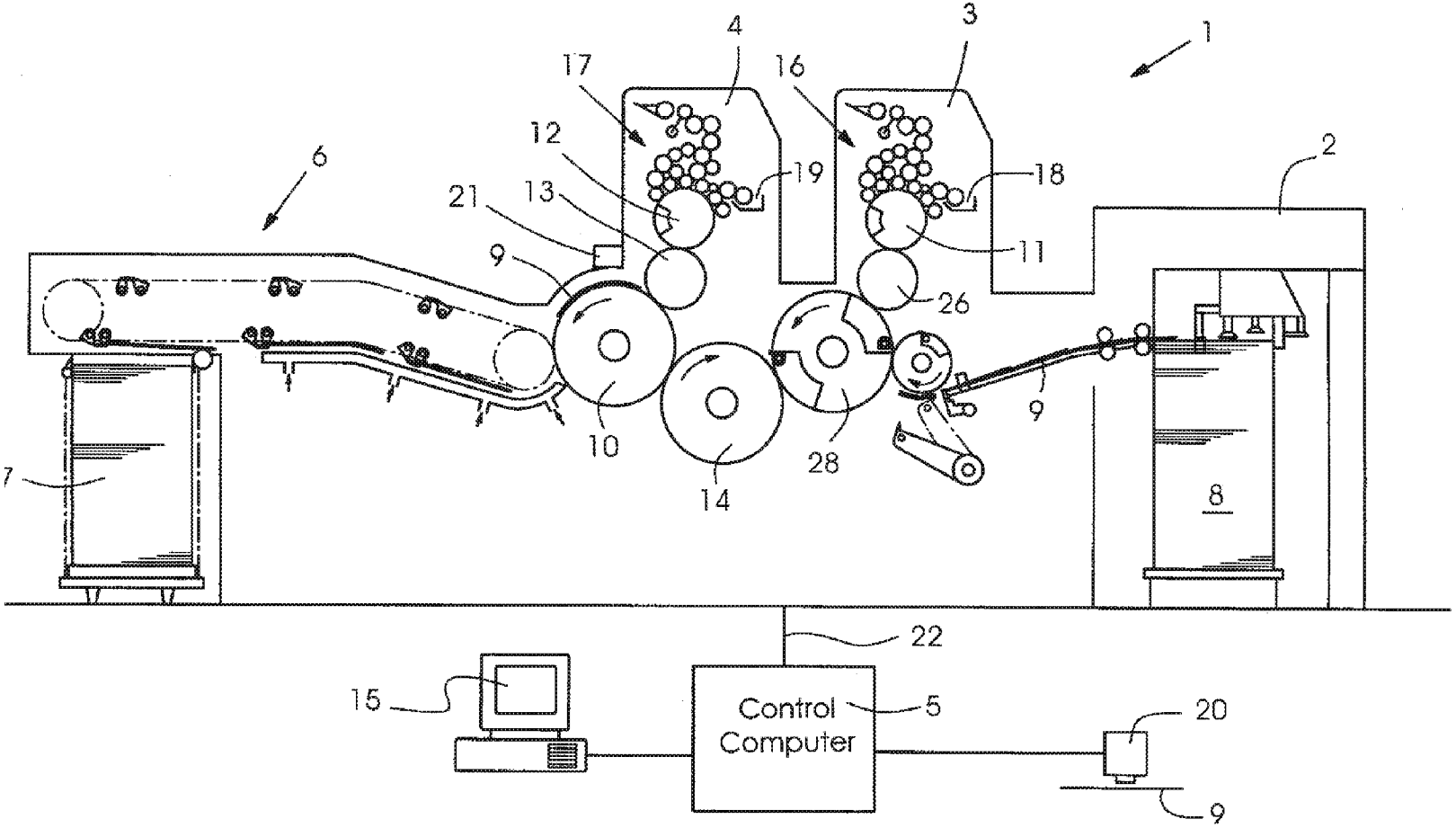
1
2
3
4
5
6
7
8
9
10
11
12
13
14
15
16
17
18
19
20
21
22
26
28
Control Computer

METHOD FOR COLOR MEASUREMENT IN PRINTING PRESSES

CROSS-REFERENCE TO RELATED APPLICATION

This application claims the priority, under 35 U.S.C. § 119, of German application DE 10 2006 014 749.9, filed Mar. 30, 2006; the prior application is herewith incorporated by reference in its entirety.

BACKGROUND OF THE INVENTION

1. Field of the Invention

The present invention relates to a method for color measurement on printing materials produced by a printing press, using at least a first color measuring device installed in the printing press and at least a second color measuring device.

In order to assess the quality of printing materials produced, the use of color measuring devices is known. By means of the color measuring devices, differences in the color between printing original and printing material produced can be detected even in a range which the human eye does not perceive clearly. In addition, by means of color measuring devices, the subjective impression of an observer can be avoided and automatic color control can be implemented. At present, calorimetric and densitometric color measuring devices are used. Of these there are three types, firstly so-called in-line measuring devices, which is to say color measuring devices which are arranged within the printing press and measure the color of printing materials continuously during continuous printing operation. Such measurements are not normally made in the printed image itself but on print control strips applied to the edge of the printing material. Furthermore, there are separate color measuring devices in the form of handheld measuring devices or measuring tables, on which the finally produced printing materials are placed and registered by a color measuring device. The color measuring devices can be connected to a control computer of the printing press, in order to carry out color control by means of a desired value-actual value comparison of the color on the printing original and the printing materials measured. The color control then acts on the inking units in the offset printing press and in this way attempts to equate the color of the finally produced printing materials to the printing original.

Commonly assigned U.S. Pat. No. 5,835,626 and its counterpart European published patent application EP 0 741 029 A2 disclose a method for open-loop or closed-loop control of the color during the printing process in printing presses, wherein measured color data is obtained continuously from printed images created and is used for the control and regulation (i.e., closed-loop control) operations to influence the color on the printing materials. If a specific tolerance limit is violated, control or regulation of the inking units in the printing press is carried out. However, a wait is not made until the tolerance limits are violated; instead a trend estimation is performed in order to extrapolate the development over time of the measured color data registered in the future. As soon as the result of the trend estimation is that the extrapolation of the trend would lead to a violation of the tolerance limits, a preventative intervention is made in the color control or color regulation. In this way, the predefined tolerance limits are not reached at all. The disadvantage with such a system is, however, that, on account of the continuously determined measured color data, a correspondingly high computing power is needed for the trend estimation in order to be able to react in good time to the trend that is manifested. Furthermore, the method according to U.S. Pat. No. 5,835,626 and EP 0 741 029 A2 is suitable only for the continuous printing process when the state of the color is already extensively stable. During the setup phase, however, the color is subject to relatively large fluctuations, so that here a trend estimation as in U.S. Pat. No. 5,835,626 and EP 0 741 029 A2 is not able to supply any criteria for reaching a stable state.

SUMMARY OF THE INVENTION

It is an object of the present invention to provide an apparatus and a method for color measurement on printing materials produced by a printing press which overcomes the disadvantages of the prior art and permits reliable measurement in the stable state shortly after the printing press has been run up and, in addition, permits economical but precise absolute color measurement of printing materials during continuous printing operation.

With the above and other objects in view there is provided, in accordance with the invention, a method and an apparatus for color measurement on printed materials produced by a printing press. The method comprises the following steps:

measuring with at least one first color measuring device installed in the printing press, and outputting a signal from the first color measuring device when measured color values registered on the printed materials are located within a predefined tolerance range for a predefined period; and after the signal has been output from the first color measuring device, performing a color measurement on one of the printed materials with at least one second color measuring device.

The method according to the invention is suitable in particular for use in sheetfed rotary printing presses but it may, in principle, also be used in web fed rotary printing presses and other types of printing machines. The invention is distinguished by the fact that two color measuring devices are used, the variation in the color of the printing materials produced being registered by the first color measuring device, which is installed in the printing press. If the result of the variation in the color is that the printing press is in a stable operating state, then a signal is output by this first color measuring device. The operating personnel then know that the printing press is in a stable operating state and can take a proof from the printing press. In sheetfed rotary printing presses, this proof is normally taken at the delivery in the form of a sample sheet and then supplied to a second color measuring device. Using this second color measuring device, an exact absolute color measurement can be carried out on the sample sheet, the results of which are then compared with the printing original. Should the deviations between sample sheet and printing original be too great, appropriate color regulation can be carried out in the inking units of the printing press. The great advantage of such a two-stage procedure is that the first color measuring device in the printing press does not have to measure as precisely as the second color measuring device, which is preferably located outside the printing press. It is therefore possible for relatively economical sensors to be installed for the first color measuring device in the printing press and, nevertheless, highly precise color measurement can be performed by means of the second measuring device, which can measure the color absolutely. This should be considered in particular under the aspect that fast highly precise in-line color measuring devices measuring absolutely in the printing press are barely available at present. However, in the case of the present invention it is possible to dispense with such expensive color measuring devices, since the first color measuring device in the printing press merely serves the purpose of detecting the stable state of the printing press and selecting the suitable time for a measurement with the precise second color measuring device.

As a second color measuring device, the known measuring devices on supporting tables and the handheld measuring devices can be used. Such measuring devices normally operate with precise spectrophotometers, this precise measurement needing a corresponding amount of time. Since the second color measuring device is located outside the printing press, this time is also available. Although, according to the present method, two measuring devices are necessary, the combination of a beneficial color measuring device in the printing press and a highly precise second color measuring device outside the printing press is substantially more economical and simpler to implement than the use of a highly precise color measuring device in the printing press, since at present these normally cannot yet currently keep up with high printing speeds.

In one refinement of the invention, provision is made for the first and the second color measuring device to be connected to each other via a communications link. As soon as the measurements determined in the printing press by the first color measuring device have proven to be stable for a predefined period and a predefined tolerance array, the first color measuring device can output a signal to the second color measuring device via the communications link, to the effect that a measurement can now be carried out on a sample sheet. In this case, the printer takes a sample sheet from the printing press and lays it on the second color measuring device. This refinement of the invention is expedient in particular when the second color measuring device is integrated into the operating desk of the printing press, since then the printer receives the signal to carry out a precise measurement with the second color measuring device directly in the color measuring device on his operating desk. At the same time, the measured values from the first color measuring device can be transmitted to the operating device of the second color measuring device and thus displayed beside one another. In this way, the printer can check whether the measured values from the first and the second color measuring device are plausible. Thus, mutual monitoring of the first and second color measuring device is carried out.

In a further refinement of the invention, provision is made for the predefined period to correspond to a predefined time interval. For example, it is possible to define that a stable state of the printing press has been reached when the tolerance limits for the color at a specific printing speed have not been violated for a time interval of one minute. If, under this condition, the predefined time period has expired, the signal to remove a proof is displayed. As an alternative to this, it is possible to provide for the predefined period to correspond to a predefined number of printing materials produced. In this case, the predefined period does not depend on the printing speed; instead, for example, a number of 100 sheets is predefined, after whose measurement it is established whether these 100 sheets lie within the permissible tolerance limits. If this is the case, in a manner analogous to the predefined time interval, a signal to measure with the second color measuring device is output, since the state of the printing press can then be seen as sufficiently stable.

Furthermore, provision is made for the first or the second color measuring device to communicate with a control computer of the printing press. This is important in particular when it is intended to intervene in the inking of the printing press by using the measured color values from the second color measuring device. In this case, the measured color values from the precise second color measuring device can be transmitted directly to the control computer of the printing press and in this way be used to control the inking units in the printing press. In this way, it is possible, by means of the measured color values registered on the printing material by the second color measuring device, to carry out a desired value-actual value comparison with the measured color values from a printing original and, on the basis of the determined deviations of the measured color values, to perform color control in the inking units of the printing press. For this purpose, the printing original is stored in the control computer of the printing press in the form of measured color values. The control computer of the printing press then compares the actual values, supplied by the second color measuring device, from the printing materials produced with the desired measured color values from the printing original. The measured color values from the printing original can have been determined on the second color measuring device but can also be supplied directly to the control computer of the printing press from the prepress stage. If a permissible difference between the registered measured color values of the printing materials produced and the printing original has been exceeded, the control computer of the printing press activates the inking units in order to minimize the difference. In this case, the color is preferably readjusted from the desired value to the actual value in one step. The change in the inking units affects the printing materials in the printing press, which in turn is registered by the first color measuring device in the printing press. After a certain time, the new state in the printing press has been stabilized and the first color measuring device will determine that the printing materials produced are once more within the predefined tolerance limits. However, the tolerance limits then differ absolutely from the tolerance limits before the color control, since a somewhat different level of inking has now been reached. The tolerance limits are therefore not stored in the first color measuring device as absolute tolerance limits but as a permissible relative color deviation dE. The relative tolerance limits are used merely to determine whether the printing press is in a stable color state but not in order to measure the absolute color. It is therefore sufficient that the first color measuring device can determine the relative variation in the color. As soon as the color is within the relative tolerance limits, a corresponding signal is output to the effect that a sample sheet can be produced for absolute color measurement.

In a further refinement of the invention, provision is made for the printing materials to be measured with the first color measuring device during continuous printing operation and for a tolerance limit to be predefined for the measured colored values determined in the process; if said tolerance limit is exceeded, a warning signal is output via an operating device. In this embodiment, the first color measuring device is assigned an additional function. If the operator, by means of the second color measuring device measuring absolutely, has found a printing material which corresponds to his stipulations, then he will no longer intervene in the color control of the printing press. For the printer, it is then instead important that this state is maintained as long as possible. However, if deviations from this state should occur, then the printer would wish to be informed about this. For this purpose, in the case of a sample sheet found to be good, the printer can press a pushbutton on a monitor on the printing press or the second color measuring device, with which he switches the sensor of the first color measuring device in the printing press into a continuous printing mode. Even in this case, the first color measuring device monitors the relative variation in the color in the printing press but then outputs a signal only when the variation in the color runs outside predefined tolerance limits.

The printer is thus given a warning signal that the stable state of the printing press which he found to be good is no longer provided, and he can take a sample sheet in order to determine the precise deviation from the printing original absolutely by means of the second color measuring device.

In a particularly advantageous refinement of the invention, provision is made for the printing materials to be measured during continuous printing operation by means of the first color measuring device, for a trend of color deviations to be calculated in a computer and, in the event of a calculated trend which, if extrapolated, would lead to a violation of the predefined tolerance limits, for a warning signal to be output via an operating device. In this embodiment, a trend estimation is additionally carried out in order to be able to detect a trend in the direction of the predefined tolerance limits in good time. In this case, a warning signal is then output as soon as a trend is manifested which would lead out of the predefined tolerance limits. In this case, the fact that a deviation is immediately impending is signaled early to the printer, and he can perform an absolute measurement on a sample sheet with the second color measuring device in good time. By using this absolute measurement, an intervention can again be made in the color control of the printing press, so that a violation of the predefined tolerance limits can be avoided.

Since the first color measuring device does not have to measure absolutely, relatively inexpensive RGB sensors can be used here. The second color measuring device for the absolute color management is preferably a spectrophotometer. Instead of the RGB sensor of the first color measuring device, a camera of a known image recording device can also be used, as is frequently used in in-line image inspection systems. The recording device of the first color measuring device merely has to have a photometric resolution such that changes relevant to color can be detected. It does not have to measure these changes absolutely.

Other features which are considered as characteristic for the invention are set forth in the appended claims.

Although the invention is illustrated and described herein as embodied in method for color measurement in printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWINGS

The sole FIGURE shows a schematic side view of a sheet-fed printing press having a first and a second color measuring device.

DESCRIPTION OF THE PREFERRED EMBODIMENT

Referring now to the sole FIGURE of the drawing in detail, the printing press 1 in the FIGURE has two printing units 3, 4 which process sheet printing materials 9. The sheet printing materials 9 are removed from a feed stack 8 in the feeder 2 and supplied to the first printing units 3 via a transport device. In the printing unit 3, 4, the sheet printing materials 9 are printed in the press nips between the blanket cylinders 13, 26 and the impression cylinders 10, 29. Between the two printing units 3, 4, the sheets 9 are conveyed by way of a transport cylinder 14. Following the second printing unit 4, the finally printed sheets 9 are transferred to the delivery 6 and deposited on a delivery stack 7 by the latter. The printing units 3, 4 each have inking units 16, 17, which apply the printing ink to the printing plates on the plate cylinders 11, 12. In order to control the properties of the printing ink, damping units 18, 19 are provided in both printing units 3, 4, mix the printing ink with damping solution and in this way permit the properties of the printing ink to be influenced. From the plate cylinders 11, 12, the printing ink is transferred to the blanket cylinders 13, 26. In addition, at the exit from the second printing unit 4 there is an in-line measuring device 21, which is able to measure the color of the sheet printing materials 9 produced. The in-line measuring device 21 can be an RGB sensor, a densitometer or another image inspection device. The in-line measuring device 21 does not have to be able to measure the color on the sheets 9 absolutely; it must merely be able to register the relative variation in the color on the sheets 9.

In the FIGURE, the in-line measuring device 21 is connected to the control computer 5 of the printing press 1 via a communications link 22. The control computer 5 of the printing press 1 is further connected to a monitor 15 for the entry and display of the operating states of the printing press 1. Also connected to the control computer 5 is a second measuring device 20, which is able to measure the printing materials 9 absolutely with respect to the color. The printing materials 9 can be removed from the delivery stack 7 and their color can be measured by the measuring device 20.

The second color measuring device 20 is a precise spectrophotometer, such as is used in the ImageControl™ and AxisControl® color measuring systems from Heidelberger Druckmaschinen AG. In the printing press computer 5, the measured color values obtained by way of the second color measuring device 20 can be compared with the measured color values from a printing original and the deviations determined in the process can be used to control the inking units 16, 17. To this end, a desired value-actual value comparison (i.e., a setpoint/actual comparison) of the measured color values determined by the measuring device 20 and the printing original is carried out, and the inking units 16, 17 of the printing press 1 are activated accordingly. The inking units 16, 17 have actuating drives, with which ink metering elements can be opened and closed, in order in this way to be able to regulate the application of ink. The actuating drives are activated by the control computer 5.

When the printing press 1 is started up, it takes a certain amount of time before a stable operating state has been established. In this phase, the in-line measuring device 21 registers the fact that the variation in the color changes continually. This is detected by means of the fact that a predefined relative tolerance band is defined in the control computer 5, which tolerance band must not be violated for a specific number of sheets 9. This tolerance band is a relative tolerance band, not an absolute tolerance band, which is to say that it always depends on the predefined intended color values and comprises a region dE around these desired values. As soon as the measured values registered on the sheets 9 by the in-line measuring device have stabilized, the measured values for a predefined number of sheets, e.g. 100 sheets, come to lie within the relevant tolerance band. If this is the case, then the in-line measuring device 21 outputs a signal to the computer 5 of the printing press. This signal can be displayed on the monitor 15 and/or on the measuring device 20. The printer is therefore given a signal that the printing press 1 is in a stable production state and he can take a sample sheet 9 from the delivery stack 7. This sample sheet 9 is then measured with the highly precise absolute color measuring device 20, in order to be able to detect any deviations between printing original and printing materials 9 produced. If a color deviation is detected which exceeds a predefined permissible color error dE, the control computer 5 intervenes in the color control and ensures that the inking units 16, 17 apply more or less ink to the printing materials 9. This control step initially leads to the operating state of the printing press 1 becoming unstable, at least for a short time. This is registered by the in-line measuring device 21, which outputs a signal again only when a new stable state has been established for the predefined number of sheets 9. Should this be the case, then the signal for pulling a sample sheet 9 is output again and the operator will once more carry out the measurement with the absolute color measuring device 20.

After one or more passes, the deviations on the sheets produced 9 as compared with the printing original will be within a permissible range, so that sheets 9 now found to be good will be produced. However, it is not possible to rule out the situation wherein, on account of influences, this state of the printing press 1 which is stable and found to be good will worsen. For this purpose, the in-line measuring device 21 is switched into a second mode wherein, although it continues to determine the variation in the color of the sheets 9, outputs a warning message to the monitor 15 when the variation in the color threatens to exceed a predefined tolerance band. If such a warning message has been output, the printer knows that the color on the sheets 9 has changed and he must pull a further sample sheet 9. In this case, the printer waits until, in a further step, the in-line measuring device 21 signals the fact that the state of the printing press 1 has stabilized again. To this end, the in-line measuring device 21 once more outputs a signal to the monitor 15 or the color measuring device 20 to the effect that a sample sheet 9 can be pulled. The printer then once more removes a sample sheet 9 from the delivery stack 7 and lays it under the second color measuring device 20 measuring absolutely. The second color measuring device 20 will then pass on the deviations on the further sample sheet 9, caused by the printing process, to the control computer 5 of the printing press, which transmits an appropriate actuating command relating to color control to the inking units 16, 17. The entire cycle then begins once more from the start until the desired color is reached again and the printing press 1 is again in a stable state.

We claim:

1. A method for color measurement on printed materials produced by a printing press, which comprises:

measuring color values on the printed materials with at least one first color measuring device installed in the printing press;

determining that the printing press has reached a stable production state when measured color values registered on the printed materials are located within a predefined tolerance range for a predefined period;

after the printing press has reached the stable production state, outputting a signal from the first color measuring device on a monitor; and after the signal has been output from the first color measuring device on the monitor, performing a color measurement on one of the printed materials produced during the reached stable production state with at least one second color measuring device.

2. The method according to claim 1, wherein the second color measuring device is located outside the printing press.

3. The method according to claim 1, wherein the first color measuring device and the second color measuring device are connected to each other via a communications link.

4. The method according to claim 1, wherein the predefined period corresponds to a predefined time interval.

5. The method according to claim 1, wherein the predefined period corresponds to a predefined number of printed materials produced.

6. The method according to claim 1, wherein at least one of the first color measuring device and the second color measuring device communicates with a control computer of the printing press.

7. The method according to claim 1, which comprises:

deriving measured color values from the color measurement on the printed material with the second color measuring device, and comparing the measured color values with a print original; and based on a determined deviation of the measured color values, performing color control operations in inking units of the printing press.

8. The method according to claim 1, which comprises measuring the printed materials with the first color measuring device during a continuous printing operation and defining a tolerance limit for the measured colored values determined in the process, and, if the tolerance limit is exceeded, outputting a warning signal via an operating device.

9. The method according to claim 8, which comprises measuring the printed materials during the continuous printing operation by way of the first color measuring device, calculating a trend of color deviations in a computer and, if the trend would lead to a violation of predefined tolerance limits when extrapolated, outputting a warning signal via an operating device.

10. The method according to claim 1, wherein the signal from the first color measuring device is output only after the printing press has reached the stable production state.

11. The method according to claim 1, wherein the signal output on the monitor indicates that the printing press has reached the stable production state.

* * * * *